US006408154B1

(12) United States Patent
Fotland et al.

(10) Patent No.: US 6,408,154 B1
(45) Date of Patent: Jun. 18, 2002

(54) METHOD AND APPARATUS FOR ENHANCING ELECTROSTATIC IMAGES

(76) Inventors: Richard Allen Fotland, 1 Crab Apple La., Franklin, MA (US) 02038; Thomas D. Kegelman, 1974 Downing Pl., Palm Harbor, FL (US) 34683

( * ) Notice: Subject to any disclaimer, the term of this patent is extended or adjusted under 35 U.S.C. 154(b) by 0 days.

(21) Appl. No.: 09/606,584

(22) Filed: Jun. 29, 2000

Related U.S. Application Data

(60) Provisional application No. 60/142,401, filed on Jul. 6, 1999.

(51) Int. Cl.[7] ..... G03G 15/08; G03G 21/00

(52) U.S. Cl. ..... 399/296; 399/355; 399/358

(58) Field of Search ..... 399/98, 99, 100, 399/128, 296, 285, 344, 355, 356, 357, 358, 359, 360

(56) References Cited

U.S. PATENT DOCUMENTS 4,365,549 A 12/1982 Fotland et al.
4,476,387 A 10/1984 Cobb et al.
4,839,673 A 6/1989 Kegelman et al.
5,172,171 A 12/1992 Beadet et al.
5,752,138 A * 5/1998 Wing et al. ..... 399/264
5,826,147 A * 10/1998 Liu et al. ..... 399/237
6,047,155 A * 4/2000 Pietrowski et al. ..... 399/296
6,052,550 A * 4/2000 Thornton et al. ..... 399/237

* cited by examiner

*Primary Examiner*—Sophia S. Chen
*Assistant Examiner*—Hoang Ngo

(57) ABSTRACT

Method and apparatus for eliminating stray background toner in electrostatic printer images by first electrostatically neutralizing any background toner charge and then removing neutralized toner. An ac corona wire positioned between a developer unit and a background toner scavenger is employed to neutralize unwanted background toner. Alternately, a high current density ac discharge between two electrodes separated by a dielectric layer may be employed as a bipolar ion source. Toner may be scavenged using either a vacuum suction manifold and/or a rotating brush.

9 Claims, 1 Drawing Sheet

METHOD AND APPARATUS FOR ENHANCING ELECTROSTATIC IMAGES

This application claims benefit to provisional 60/142,401 filed Jul. 6, 1999.

BACKGROUND OF THE INVENTION

Electrostatic non-impact printers employ apparatus to form latent electrostatic images on an insulating surface. This electrostatic latent image attracts toner from a developer station to render a visible image. The toned image is then transferred to paper at a transfer station. Toner particles are generally either inductively or triboelectrically charged to a potential opposite to that of the latent image so that they will be attracted and adhere to the electrostatic image and not to the non-charged background image. In an alternate arrangement, the developer unit is biased to the potential of the charge image and then toner is adhered in non-charged areas.

Toner may be transferred to paper using either pressure transfer or electrostatic transfer. In pressure transfer, as described in Fotland and Carrish, U.S. Pat. No. 4,365,549 (Dec. 28, 1982) for example, the toner is pressed into the paper fibers under high pressure developed in a transfer nip. Typical peak pressures are several thousand pounds per square inch corresponding to nip roller loadings of a few hundred pounds per linear inch of nip. In a typical electrostatic toner transfer, the back, or non-imaged side of the paper is exposed to the field of a corona the polarity of which is opposite to that of the toner that adheres to the image. Transfer of the toner image takes place when the paper is in contact with the image surface.

In order to eliminate background toner in white areas, care must be taken to assure that all toner particles have a net charge. In high-speed operation, it is difficult to relatively uniformly charge all toner particles in the developer unit and thus some toner is deposited in background areas.

In many cases, it is desired to generate a high-density image using a relatively low image charge density. This feature provides for higher speed more efficient printer operation. The formation of high optical density images at low charge levels require a low specific toner charge level and thus can also result in the development of background toner.

Kegelman, U.S. Pat. No. 4,839,673 (Jun. 13, 1989) teaches the use of an ac corona treatment just prior to electrostatic image transfer. While the Kegelman patent teaches the use of an ac corona to minimize background, no mention is made of means to remove neutralized toner prior to electrostatic transfer.

SUMMARY OF THE INVENTION

The present invention has been made with the foregoing background in mind.

An object of the present invention is to provide a method for reducing toner scatter and toner background in electrostatically developed images. More specifically, the invention provides for the use of an alternating current discharge and physical removal of undesired toner from the surface of imaging members subsequent to latent image development and prior to toner image transfer.

Another object of the present invention is to provide a method and apparatus for improving image edge acuity or sharpness by the elimination of same or wrong sign toner developed at image edges as a consequence of fringing field toner attraction.

A further advantage is provided when employing colored toners and particularly those employing polyester resin as a binder. Such toners often exhibit non-uniform triboelectric charge characteristics and a change in color pigment generally results in a change in triboelectric surface characteristics.

In addition, the present invention greatly reduces background toner levels when printing at very high speed using very fine toner particles. Fine particles produce higher acuity images but, at high operating speed, lead to the formation of a dust cloud near the toning region. This dust cloud invariably results in some undesired toner deposition in uncharged areas of the toner receptive surface.

Furthermore, the present invention minimizes image degradation caused by toner and carrier aging effects that generally result in tribocharge degradation.

High speed electrostatic latent image development using triboelectric or corona charged toner suffers from background toner scatter due to the presence of small amounts of wrong sign toner as well as from image charge forces in background areas. The present invention neutralizes undesired toner charge that can then be easily removed from the surface of the latent image carrier.

Toner deposited on an insulating surface during printer operation may have two forms of countercharge. The desired form is countercharge that resides on the surface of the insulator as a latent image. Such latent image may be formed from the charging and optical discharge of a photoconductor or, alternately, from a remote image charge generator charging a dielectric surface. Charged toner is electrostatically attracted and bound to such surface charge to form the desired visible image. Undesired background toner, of either charge polarity, may be formed in areas having no surface charge. In this case, the deposited toner electrostatic mirror image resides in the conducting substrate adjacent the insulating layer.

It is the difference in countercharge location and, more specifically, the bound versus mobile aspect of the two types of countercharge that provides the opportunity to eliminate background toner. This is accomplished by providing a high charge density bipolar (positive and negative) charge near the toner surface. Charge bound to the surface of the insulator or photoconductor may not be discharged while the mobile charge at the insulator substrate may be neutralized by the charge at the toner surface. This essentially removes any background toner charge and thus permits the easy removal of background charge by, for example, suction means.

DESCRIPTION OF THE INVENTION

Figure 1:
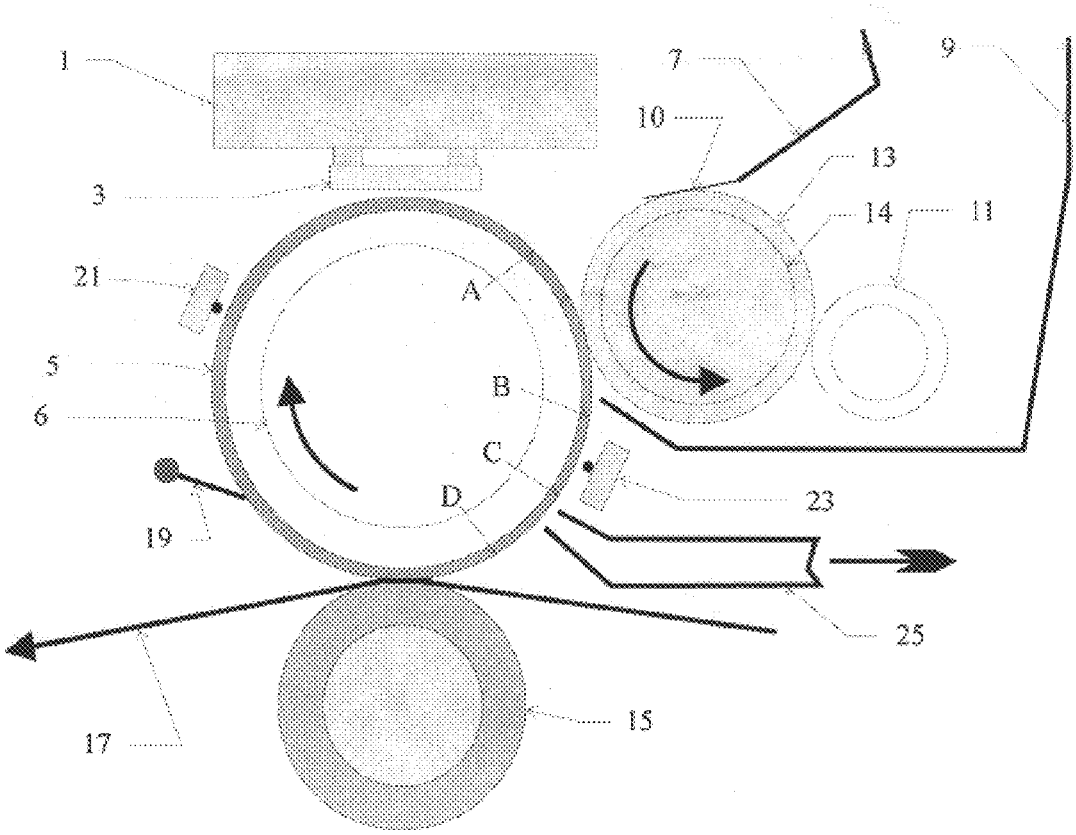
FIG. 1 schematically illustrates an electrographic printer including the imaging enhancing apparatus of the present invention.
Figure 2:
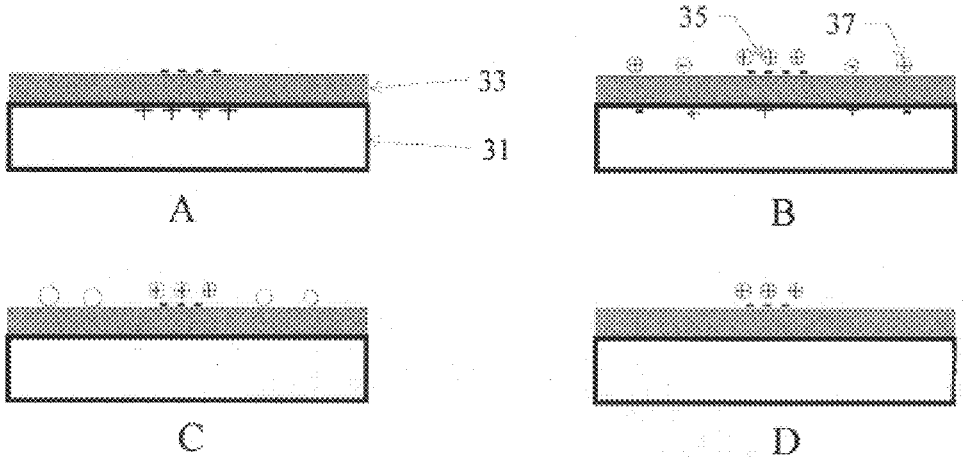
FIG. 2 is a schematic illustration showing the four steps in the method and apparatus of the present invention.

The method of the present invention is illustrated in FIG. 1 that depicts a typical high-speed web printer incorporating means to discharge and remove undesired toner from the surface of an imaging drum. FIG. 2 includes four schematic sketches illustrating what is believed to be the mechanism of operation of the present invention.

The basic printing engine of FIG. 1 is described in Fotland and Carrish, U.S. Pat. No. 4,365,549 (Dec. 28, 1982). A latent electrostatic image is generated by driver circuitry 1 that energizes charge generating print head 3. Details of these components are found in the above referenced patent. An image drum is comprised of dielectric coating 5 supported by a cylindrical conducting support 6. Typical drums are also described in the above referenced patent. The latent electrostatic image is developed, in the example shown here, using a non-conductive, non-magnetic toner. Toner is supplied to housing formed by elements 7 and 9. Roller 11 applies toner to developer roll coating 13 as well as partially tribocharging the applied toner. The developer roll is constructed of semiconducting elastomer coating 13 on metal core 14. Metering blade 10 controls the thickness of toner on roll 13 and serves to further tribo-charge the toner. The toned image is simultaneously transferred and fused to image receptor web 17 in the nip formed by the image drum 5 and pressure roll 15. Any residual toner or paper dust is removed from the surface of the image drum by scraper blade 19. Any residual charge on the surface of drum 5 is removed using bipolar charge generator 21. Cobb and Fotland, U.S. Pat. No. 4,379,969 describes a preferred ac charge generator.

Operation of the printer described above leads to the presence of small amounts of background toner at high operating speeds. This effect is particularly objectionable at process speeds in excess of 50 inches per second. This invention adds new elements 23 and 25 to the basic printer. Bipolar (positive plus negative) charge generator 23 neutralizes background toner charge. This generator may be of the same type as generator 21. Optionally, generator 23 may be operated in a sheath of clean air to prevent toner contamination. Alternately, the bipolar charge generator may consist of a corona generating wire and partial shell as described in Kegelman et al, U.S. Pat No. 4,839,673. At high operating speeds, the voltage applied to the corona wire must be supplied at a frequency of several kilohertz in order to avoid image banding as the toner imaging surface moves rapidly under the discharge corona assembly.

Discharged toner is removed from the surface of image drum 5 by rapid airflow provided by vacuum introduced by manifold 25. A pressurized air-knife (not shown) immediately adjacent the vacuum manifold slot may be employed to provide makeup air for the vacuum unit. Toner removed by airflow through the manifold may be collected using a cyclone separator or an appropriate air filter. The toner collected in this manner may be recovered and recycled to development unit. Although not shown, the discharged toner may also be removed using a very soft rotating brush.

The four illustrations A,B,C,D of FIG. 2 show charge and toner distribution on the image drum corresponding to regions A,B,C,D shown in FIG. 1. Element 33 is the dielectric layer corresponding to element 5 in FIG. 1. Element 31 corresponds to conducting support 6 of FIG. 1.

Sketch A schematically illustrates a charge latent image consisting of four negative charges. These negative charges are compensated by four free positive charges residing in the conducting substrate 31. In sketch B, the latent charge image has been developed. The image toner, shown here as three positive charged particles 35, compensates three of the negative surface charges. Development is not shown as progressing to completion as typical at very high process speeds. Thus, the fourth surface bound negative charge has a free compensating charge in the substrate. Also shown in B are four charged toner particles, each of which has an associated free counter charge in the conducting substrate. These undesired particles contribute to image background. Sketch C illustrates the situation after the surface is discharged by ac charge generator 23 of FIG. 1. Here, the three image toner particles, being coupled to their countercharge bound on the surface of the imaging drum, are not discharged. The five positive free charges in the conducting substrate are eliminated as the charge from the ac generator discharges background toner particles. The four background toner particles may now be readily vacuumed from the imaging drum surface. Sketch D illustrates the remaining toner particles after vacuuming. As shown in FIG. 1, the condition at D exists between the process steps of vacuuming and image transfer.

EXAMPLE

An apparatus as described in detail in Beaudet and Kaplan, U.S. Pat. No. 5,172,171 (Dec. 15, 1992) is setup and operated with a continuous paper web. Print engines of this design are available from Idax Systems, Canton, Mass. Operation of this engine at web speeds in excess of 200 feet per minute results in the formation of objectionable background toner. The printer engine is modified by incorporating a high current density bipolar charge source in a position as shown by component 23 in FIG. 1. The bipolar generator is composed of a fine wire mesh screen mounted directly over a glass-covered wire. The mesh screen is permanently positioned about 0.02 cm from the surface of the toner imaging surface. This mesh screen is maintained at ground potential. The dielectric cylinder base is also at ground potential. The generator is described in detail in example one of Cobb and Fotland U.S. Pat. No. 4,476,387 (Oct. 9, 1984).

A second modification adds a vacuum manifold, component 25 of FIG. 1. A manifold slot width of one cm. is employed with the manifold spaced about 0.2 cm. from the dielectric surface. Use of the bipolar generator and the manifold would allow operation at the maximum design speed of 300 feet per minute without any observable background toner in the printed image.

It is to be understood that variations, modifications, and rearrangements may be made while still coming within the scope of the invention. One such variation would include the use of the bipolar generator and vacuum manifold in a laser printer employing a photoconductor as the latent image substrate. Another modification may be employed with images developed with magnetic toner. Here, the air suction or rotating brush toner scavenger is replaced with a rotating magnet spaced very closely to the dielectric cylinder. Many other modifications and variations therein will readily occur to those skilled in the art. Accordingly, all such variations and modifications are included within the intended scope of the invention.

What is claimed is:

1. An improved electrostatic printing method for minimizing toner background in electrostatic printers that comprises the steps of:

forming an electrostatically toned image on an insulating surface, exposing said insulating surface to positive and negative charges, removing any loosely bound toner from said insulating surface, and then transferring remaining said toned image to a receptor substrate.

2. The method of claim 1 wherein said positive and negative charges are generated using an alternating current excited corona wire.

3. The method of claim 1 wherein said positive and negative charges are generated by forming a high frequency discharge between two elongate conductors separated by an insulator.

4. The method of claim 1 wherein said loosely bound toner is removed using a high velocity air stream.

5. The method of claim 1 wherein said loosely bound toner is removed using a rotating brush arranged to lightly contact said receptor surface.

6. The method of claim 1 wherein said transfer method comprises electrostatic transfer of the toner image to a receptor substrate.

7. The method of claim 1 wherein said transfer method comprises pressure transfer of the toner image to a receptor substrate.

8. The method of claim 1 wherein said insulating surface comprises the surface of a photoconductor.

9. The method of claim 1 wherein said insulating surface comprises the surface of a dielectric material.

* * * * *